United States Patent [19]

Belanger et al.

[11] Patent Number: 4,799,287

[45] Date of Patent: Jan. 24, 1989

[54] BLOWER HOUSING CONSTRUCTION

[75] Inventors: James A. Belanger; Robert J. Wentworth, both of Northville; Barry S. Turner, Livonia; Graham J. Astley, Novi, all of Mich.

[73] Assignee: Belanger, Inc., Northville, Mich.

[21] Appl. No.: 45,331

[22] Filed: May 4, 1987

[51] Int. Cl.[4] ..... A47L 5/14

[52] U.S. Cl. ..... 15/405; 15/330; 285/253; 285/903; 415/206

[58] Field of Search ..... 15/330, 344, 345, 339, 15/405, 412; 415/206 X, 214; 403/344; 285/253 X, 903 X

[56] References Cited

U.S. PATENT DOCUMENTS

| | | | |
|---|---|---|---|
| 1,264,659 | 4/1918 | Klimek | 285/253 |
| 2,734,214 | 2/1956 | Gerber | 15/330 X |
| 3,322,070 | 5/1967 | Glass | 415/206 |
| 3,501,179 | 3/1970 | Boynton et al. | 285/903 |
| 3,824,028 | 7/1974 | Zenker et al. | 415/206 |
| 4,202,296 | 5/1980 | Nonnenmann et al. | 415/206 |
| 4,223,419 | 9/1980 | Sato et al. | 15/405 |
| 4,549,848 | 10/1985 | Wallman | 415/206 |
| 4,592,576 | 6/1986 | Proctor et al. | 285/253 |
| 4,644,606 | 2/1987 | Luerken et al. | 15/330 |

FOREIGN PATENT DOCUMENTS

| | | | |
|---|---|---|---|
| 2203897 | 1/1972 | Fed. Rep. of Germany | 415/206 |
| 3304964 | 8/1984 | Fed. Rep. of Germany | 415/206 |
| 2554177 | 5/1985 | France | 415/206 |

*Primary Examiner*—Timothy F. Simone
*Assistant Examiner*—Corinne M. Reinckens
*Attorney, Agent, or Firm*—Cullen, Sloman, Cantor, Grauer, Scott & Rutherford

[57] ABSTRACT

A blower comprises a unit blower housing of molded plastic material having a circular outer wall and laterally spaced front and rear walls, defining an impeller chamber and a tangential outlet upon a first axis adapted to receive a flexible hose. The outlet defines with an end portion of the outer wall a reverse curved cut off edge extending between the side walls. An opening in the front wall is arranged upon a second axis at right angles to the first axis and receives an air inlet cone secured to the housing by a plurality of threaded inserts molded into the housing. An electric motor upon a support has a drive shaft extending through the rear wall. The rear wall is mounted upon and secured to the motor and an impeller is positioned within the housing and axially mounted upon the motor shaft and has an air intake receiving the air inlet cone. The second axis is so arranged relative to the first axis that the impeller defines with the cut off edge an optimum gap of reduced dimension for a smooth non-turbulent, substantially noiseless airflow through the outlet.

14 Claims, 4 Drawing Sheets

FIG. 5
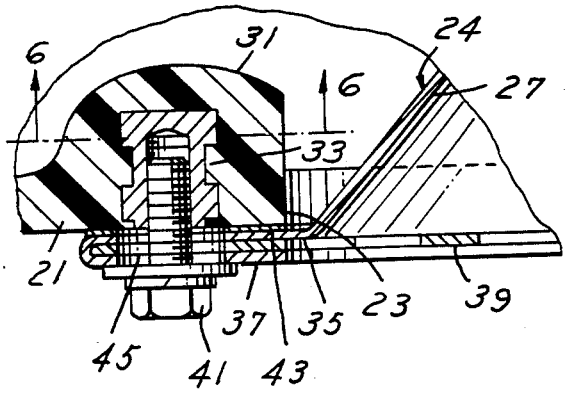
FIG. 6
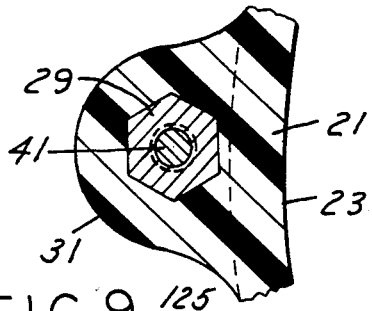
FIG. 9
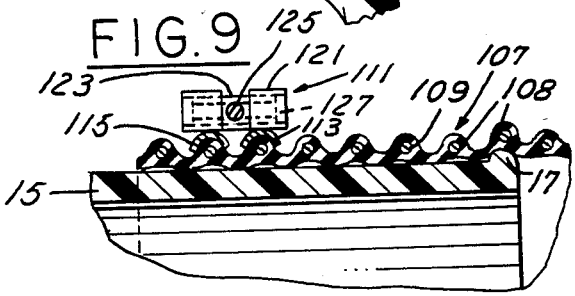
FIG. 7
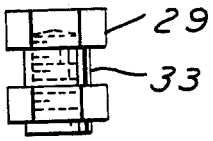
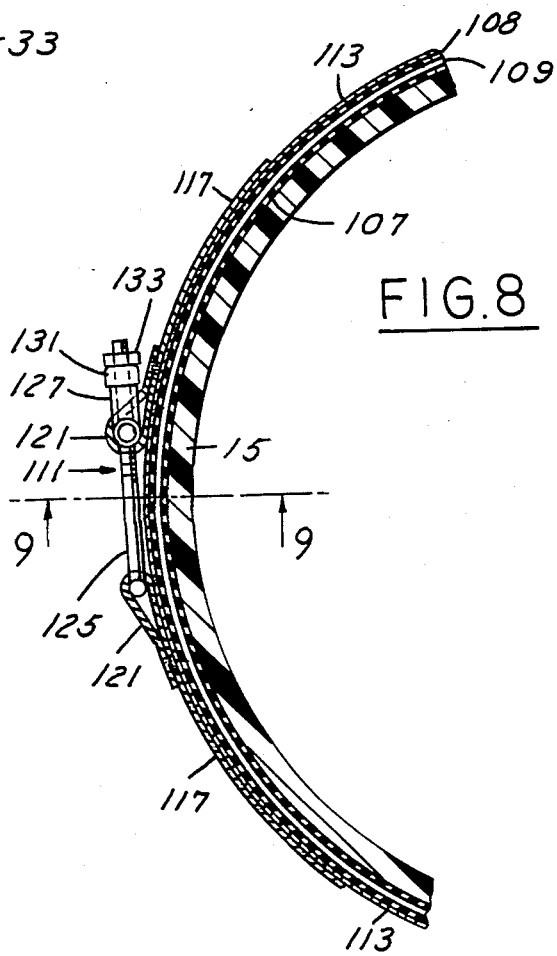
FIG. 8

BLOWER HOUSING CONSTRUCTION

FIELD OF THE INVENTION

The present invention relates to air blowers, and more particularly to a unit blower housing of molded plastic material having a tangential outlet adapted to receive a flexible hose.

BACKGROUND OF THE INVENTION

Previously, air blower housings have tangential outlets have been formed of metal. Attached to the housing was a separate cut-off part or element located in the housing adjacent the outlet. Due to interrupted wall interiors, interior obstructions, including fasteners, the flow of air under pressure from a power rotated impeller has been turbulent, noisy and inefficient.

There have been difficulties in securing and retaining a flexible hose over the outlet of the air blower housing. There have also been difficulties in mounting an air inlet cone within and around an aperture in the air blower housing and inefficiently securing the air inlet cone in position and in mounting a screen over the inlet of such air inlet cone.

Problems have also been encountered in the field in removably mounting an impeller within the air blower housing, removably attaching the blower housing to a motor, and in connecting the motor shaft to the impeller so that the impeller could be readily removed from the shaft, motor and housing for repair, reconstruction or replacement.

Heretofore, impeller housing have also been oversized with respect to the impeller resulting in loss of efficiency and reduced air flow.

SUMMARY OF THE INVENTION

An important feature of the present invention is to provide a blower assembly which includes a unit blower housing made from a molded plastic material and having a tangential air outlet.

Another feature is to provide a unit blower housing of molded plastic material having a circular outer wall and laterally spaced front and rear walls defining an impeller chamber and a tangential outlet arranged upon a first axis adapted to receive a flexible hose.

Still another feature is that the outlet defines with an end portion of the outer wall of the molded housing a reverse curved cut-off edge which extends between the opposed side walls of the unit blower housing.

A further feature is that unit blower housing is constructed of a high molecular weight polyethylene material.

A still further feature is to provide a plurality of spaced insert fasteners selectively molded, interlocked and non-rotatably enclosed within the front or rear wall of the housing and forming a permanent part thereof. The selection as to whether the insert fasteners are molded into the front or rear wall of the housing is determined by how the housing is mounted in the structural frame and by whether the interior of the housing is to be accessible through an opening provided in the front wall or in the rear wall.

Another feature is to cut a circular opening within one of the side walls of the housing which corresponds to the wall in which the fasteners are nested and anchored, with the opening defining a circular inlet opening to the internal chamber of the blower housing arranged upon a second axis at right angles to and spaced from the first longitudinal axis of the housing tangential outlet.

Still another feature of the present invention is to form such sufficient apertures within the other of the pair of side walls of the housing which are adapted to receive the drive shaft of a motor for driving the internal impeller within the blower housing and for receiving fasteners for anchoring the blower housing to the motor.

Still another feature is to provide means between one side wall of the blower housing and the motor for aligning the motor shaft with the second axis for securing and mounting the rear wall of the blower housing to the motor.

A further feature is to provide a conventional impeller construction which is oversized with respect to the internal chamber of the unit blower housing and which is mounted in the chamber. The impeller cooperatively receives the annular convex throated outlet of the novel air inlet cone for the smooth introduction of atmospheric air into the impeller.

A still further feature is to arrange the air inlet opening along the first axis so that the impeller defines with the molded unit formed cut-off point within the blower housing an optimum gap of reduced dimension for assuring the maximum smooth non-turbulent substantially noiseless air flow through the outlet.

Another feature is to provide an annular rib formed upon and adjacent the end of the blower housing outlet in cooperation with an elongated flexible and corrugated hose interlocked over the rib against relative longitudinal movement and for use in conjunction with an adjustable clamp assembly which extends around and compressively engages the hose and the outlet.

Still another feature is to provide a plurality of fasteners extending through the flange of the air inlet cone and threaded into the fasteners which are molded, interlocked and non-rotatably enclosed within one of the walls of the blower housing.

It is another feature to mount the power rotated impeller within the chamber of the blower housing upon the second axis, with the chamber starting at the cut-off point being of progressively increasing radial dimension and transverse cross-sectional dimension from the impeller perimeter to provide a smooth non-turbulent substantially noiseless air flow through the outlet.

Another feature is to provide an improved mounting for the circular screen upon the air inlet cone, with the mount flange of the air inlet cone including an annular reverse turned anchor flange overlying the mount flange and defining a channel. With such a construction, the screen is peripherally nested and protectively anchored within the channel, and the same fasteners as employed for the inlet air cone extend through the anchor flange, the screen and the mount flange and into the fasteners molded within one of the walls of the blower housing.

As a further feature, the means for aligning the shaft with the second axis include a motor pilot plate having a circular recess arranged upon the second axis and upon the exterior of the rear wall of the housing and wherein a circular mount flange upon the motor is coaxial of the drive shaft and axially nested and retained within the pilot plate.

A further feature is to provide a securing means incorporating a motor support plate arranged upon the interior of the rear wall of the housing on the second axis together with a plurality of fasteners extending through the plates and rear wall and secured to the motor.

Another important feature is to provide an improved clamp means for anchoring a flexible hose to the blower outlet which includes a flexible metal channel overlying the corrugations of the hose, the opposite ends of the channels being laterally overlapped. Spaced opposed looped anchor strips overlie the respective overlapped ends and adjacent intermediate portions of the channel and are secured to the intermediate portions. Adjustable fastening means interconnect the anchor strips for variably drawing up the intermediate portions extending the overlap of the channel ends and for fixedly anchoring the flexible hose upon the outlet of the blower housing.

Still another feature is that the insert fasteners which are molded into one of the side walls of the unit blower housing are of polygonal shape include an annular grove of reduced diameter intermediate their ends adapted to receive plastic material to thereby provide an interlock with the corresponding wall and to hold the fasteners against relative rotation.

Another important feature includes an improved mounting for the impeller including an apertured circular mount plate arranged upon the second axis and wherein an axial hub extends through the mount plate and is secured thereto. With such a construction, the mount plate is adapted to receive the motor drive shaft and is keyed thereto.

A further feature of the present invention is to provide a unit blower housing of molded plastic material which includes a generally circular outer wall and laterally spaced front and rear walls defining an impeller chamber of generally rectangular cross-section, with the housing terminating in an elongated tangential outlet arranged upon a first axis adapted to receive a hose.

A still further feature is that the blower housing has a series of spaced insert fasteners rotationally molded therein, with the fasteners permanently embedded and enclosed within one of the walls of the housing and flush with its exterior. The interior of such one wall has smooth blending non-obstructive convex embossments over and enclosing the fasteners.

Another important feature is to provide an improved air inlet cone which includes an annular converging body having an annular mount flange upon one end and an annular convex out-turned throated air outlet at its other end and wherein a circular air screen is mounted upon spans and is secured to the mount flange.

Still another feature is to provide a series of spaced fastener apertures in and around the mount flange and corresponding apertures in the screen adapted to receive exterior fasteners for projection therethrough and into the fasteners molded within the blower housing wall.

A further important feature of the present invention is to provide an adjustable clamp for a pair of engaging overlapped inner and outer cylindrical members which comprises an elongated flexible metal channel adapted to surround such members with the opposite ends of the channel laterally overlapped. With such a construction, spaced opposed looped anchor strips overlie the respective ends and adjacent intermediate portions of the channel. Each anchor strip loosely engages one channel and is secured to the adjacent intermediate portion and adjustable fastening means interconnect the anchor strips for variably drawing up the intermediate portions extending the overlap of the channel ends.

As another feature the adjustable fastening means include a T-bolt anchored within the looped end of one anchor strip, a T-sleeve anchored within the looped end of the other anchor strip and receiving the T-bolt and a fastener threaded over the T-bolt compressively engaging the T-sleeve.

An important feature of the present invention is the method of making a unit blower housing of molded plastic having a tangential outlet which comprises the steps: of (a) taking a two piece mold which when closed has an internal cavity corresponding to the outer configuration of the unit blower housing; (b) placing powdered or granular plastic in the cavity of the open mold in an ammount sufficient to form the unit blower housing; (c) closing the mold and bolting it together; (d) moving the closed mold into a heated oven while rotationally rotating the mold to melt the plastic and thereby fill the cavity with liquid plastic material and to form the unit blower housing with a tangential outlet; (e) removing the heated mold from the oven and permitting the mold to cool by air or water to solidify the plastic blower housing; and (f) removing the solidify plastic housing from the mold.

Still another feature includes the step of inserting into the mold prior to its rotation a plurality of spaced insert fasteners whereby the fasteners are permanently embedded, enclosed within and anchored selectively within one of the side walls of the unit molded housing.

A further feature of the present method includes the steps of selectively molding the fasteners into one of the sidewalls of the molded housing wherein and thereafter remove the housing from the mold and cut a circular opening through the wall containing the fasteners and inwardly thereof.

These and other features and objects will be seen from the following specification and claims in conjunction with the appended drawings.

THE DRAWINGS

FIG. 5 is a fragmentary section taken in the direction of arrows 5—5 of FIG. 1, on an increased scale.

FIG. 6 is a fragmentary section taken in the direction of arrow 6—6 of FIG. 5.

FIG. 7 is a side elevational view of the fastener shown in FIG. 5.

FIG. 8 is a fragmentary section taken in the direction of arrows 8—8 of FIG. 1, on an increased scale.

FIG. 9 is a fragmentary section taken in the direction of arrows 9—9 of FIG. 8.

It will be understood that the above drawings illustrate merely a preferred embodiment of the invention and that other embodiments are contemplated within the scope of the claims hereafter set forth.

DETAILED DESCRIPTION OF AN EMBODIMENT OF THE INVENTION

Figure 1:
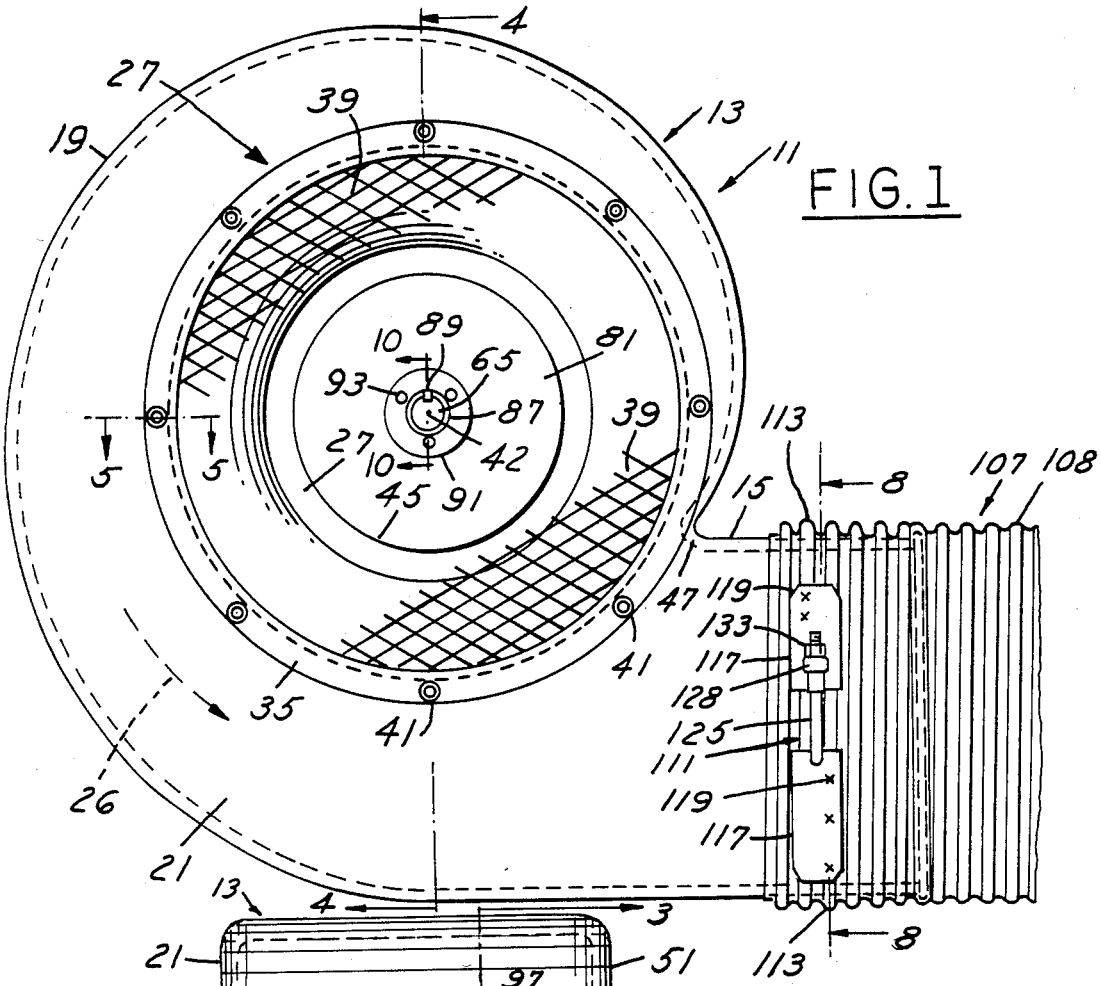
FIG. 1 is a side elevational view of the present blower assembly including the blower housing, an impeller mounted therein and with a flexible hose, fragmentarily shown, mounted over the housing outlet.
Figure 2:
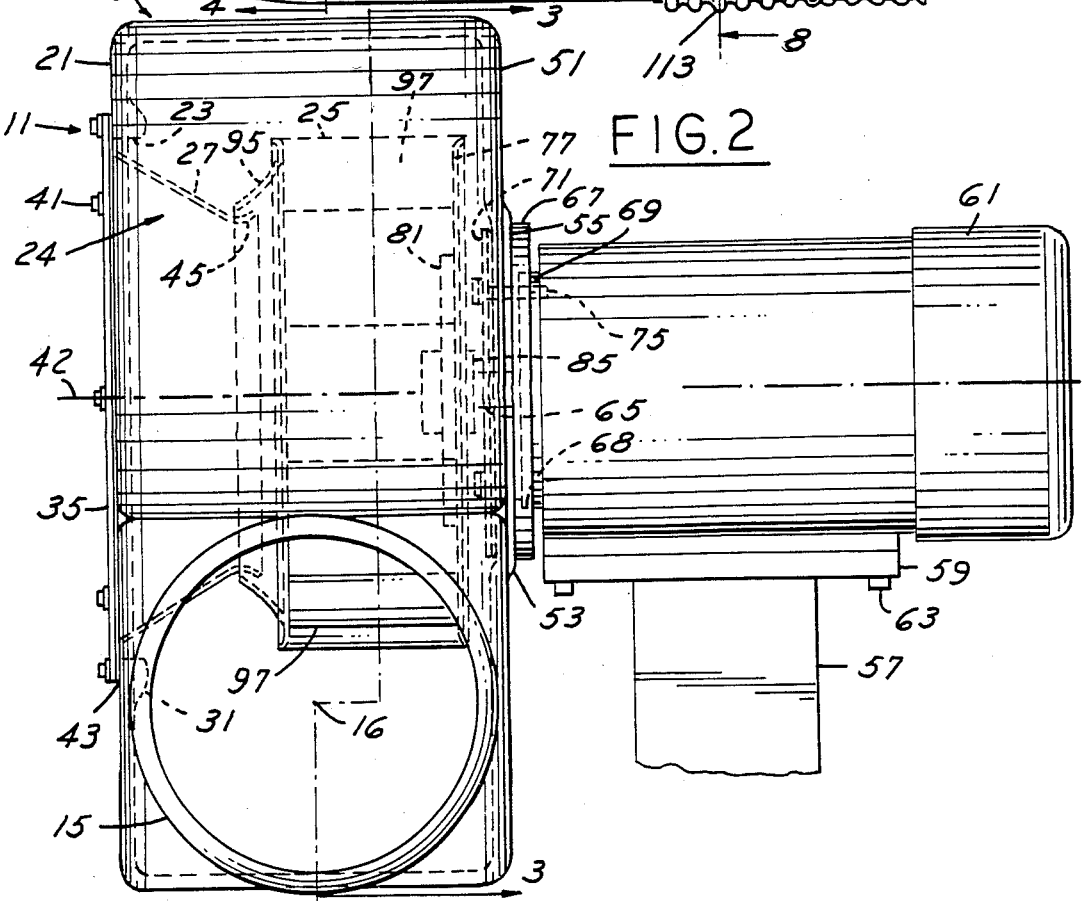
FIG. 2 is a right side elevational view of the blower assembly, with the air inlet cone and impeller shown in phantom lines and with the motor support fragmentarily shown.
Figure 3:
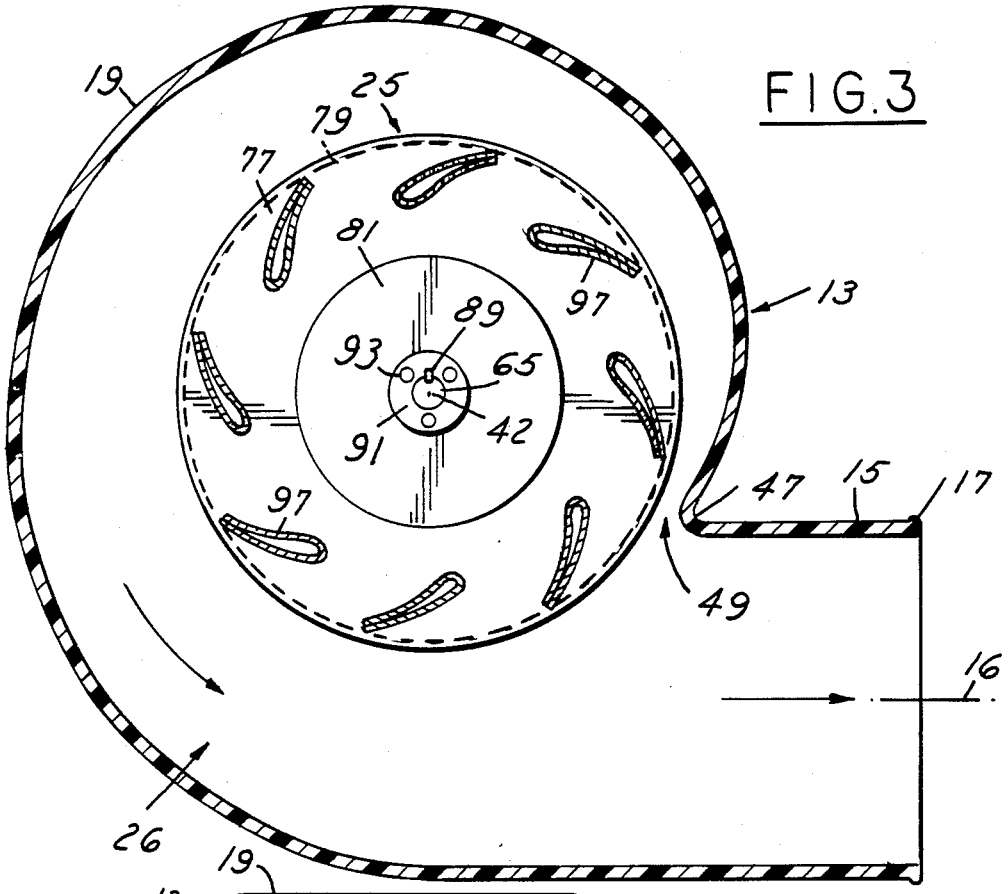
FIG. 3 is a section taken in the direction of arrows 3—3 of FIG. 2.

Referring to the drawings, FIGS. 1–4, the present blower assembly 11 includes a unit blower housing 13 of rotationally molded high molecular weight polyethylene plastic material having tangential outlet 15 molded as a part of the housing 13 and extending along a first axis 16, FIG. 3 and of circular cross-section.

Annular rib or bead 17 is molded as a part of outlet 15 and is arranged adjacent the outer end thereof. In the preferred embodiment, the unit blower housing 13 is constructed of a high molecular weight polyethylene which is tough and strong and therefore resistant to damage, is impervious to temperature changes, is inexpensive, impervious to most chemicals and cleaning agents, is easy to keep clean, is durable and long lasting. Other plastic materials may be employed for the unit blower housing.

The present unit blower housing 13 is of a rotationally molded plastic material. It has a generally circular outer wall 19 of progressively increasing radius and laterally spaced front and rear walls 21 and 51 to define an impeller chamber 26 of general rectangular cross-section, with internal radiused or circular corners 22, FIG. 4.

Figure 4:
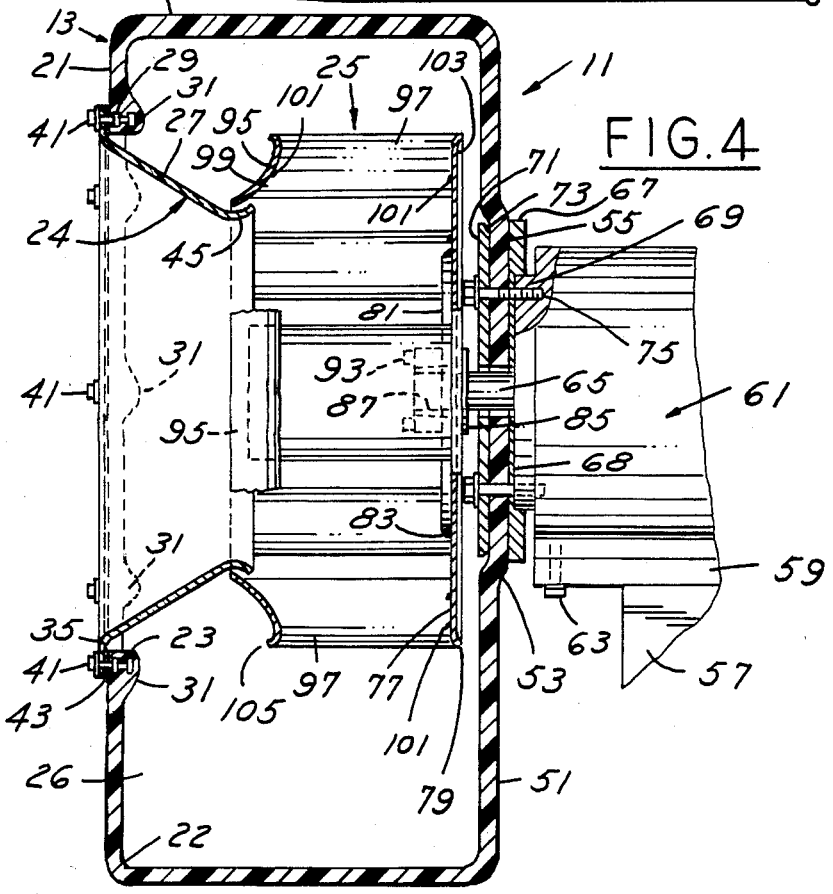
FIG. 4 is a fragmentary section taken in the direction of arrows 4—4 of FIG. 1.
Figure 10:
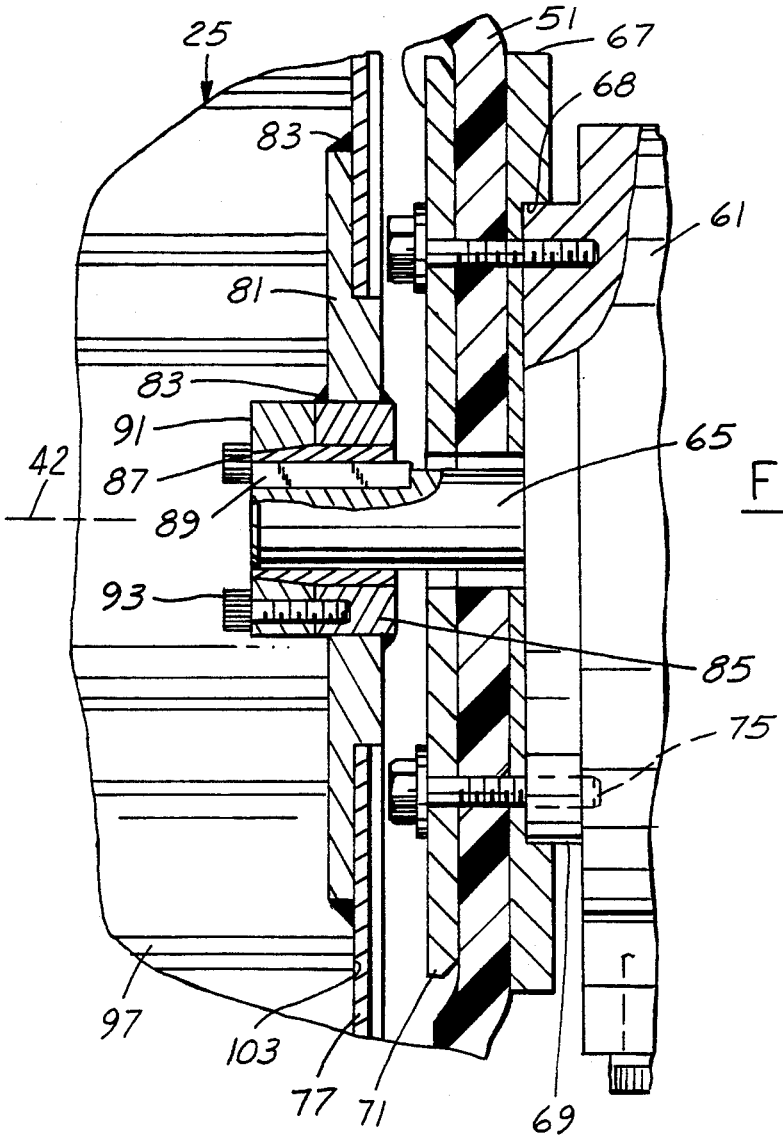
FIG. 10 is a fragmentary sectional view, taken generally along the lines 10—10 of FIG. 1, on an increased scale, and illustrating the connection between the impeller and the shaft.

The present blower housing front and rear walls 21 and 51 are normally molded without apertures or openings therein and in the assembly process one of the walls, such as front wall 21, is routed or otherwise cut to define air inlet or clearance opening 23 adapted to receive the impeller 25, FIG. 4.

The unit blower housing 13, FIGS. 1 and 3, encloses impeller 25 adapted for rotation counterclockwise. In the event that the housing 13 is to be mounted opposite to that shown, then the opposite wall 51 would be routed out to define a corresponding circular inlet opening for the impeller 25.

In the illustrative embodiment the air inlet cone 24 includes a rotationally spun body 27 including an annular mount flange at 35 at one end adapted for registry with wall 21 and secured thereto by a plurality of spaced threaded fasteners 41.

For this purpose and in the initial rotational molding of the unit blower housing 13 the plurality of insert fasteners 29, FIGS. 4–7, are positioned within the mold and during rotational molding of the unit blower housing 13 are molded therein, with the fasteners 29 permanently embedded and enclosed within the front wall 21 and flush therewith and anchored against relative longitudinal and rotational movements.

The fasteners 29 are rotationally molded and enclosed within wall 21 when an impeller 25 for counterclockwise rotation is employed, FIGS. 1 and 4. If the blower housing 13 is rotationally molded for use with an impeller which is to rotate clockwise, or the housing 13 is mounted opposite to that shown in FIG. 4, then the fasteners 29 would be embedded and molded into the corresponding rear wall 51 in a relationship similar to the relationship of the fasteners 29 shown with respect to front wall 21 of FIG. 2.

Fasteners 29, FIGS. 5, 6 and 7 are of general hexagonal shape, or polygonal and are rotationally molded into the front wall 21, and selectively under some conditions into the rear wall 51. The corresponding threaded insert fasteners sometimes referred to as threaded inserts 29, are spaced around circular opening 23.

After the blower housing 13 with the spaced insert fasteners 29 molded thereto has been completed and removed from the mold, the particular side wall of the housing 13 which mounts the fasteners 29 is cut or routed to form the clearance opening 23, FIG. 4, adapted to receive impeller 25. The interior of wall 21 adjacent the molded fasteners 29 includes a series of correspondingly spaced circular convex bosses 31 which protectively and smoothly enclose the inner ends of the respective fasteners 29 to provide a smooth air flow surface on the interior of chamber 26 which is non-obstructive to the air flowing therethrough.

As shown in FIGS. 5 and 6, fastener 29 has a molded interlock or groove at 33 with respect to the wall 21 of the housing 13 to prevent relative longitudinal movement between the fastener 29 and the housing 13. The polygonal shape of fastener 29 further interlocks the fastener against relative rotation with respect to the molded housing 13 or to the corresponding wall.

The air inlet cone 24, FIGS. 4 and 5, of spun aluminum, at one end of its body 27 has an annular mount flange 35 which normally bears against side wall 21 in the illustrative embodiment, and a suitable annular gasket 43 is interposed therebetween. The gasket 43 is preferably non-metallic such as of rubber or of a plastic material. A series of spaced apertures are formed through mount flange 35, and are adapted to receive the corresponding threaded fasteners 41 which project into the insert fasteners 29 thereby securing the air inlet cone 24 in the position shown in FIGS. 2 and 4.

Mount flange 35 has a reverse turned anchor flange 37 which overlies mount flange 35 defining a channel with corresponding spaced apertures therein to receive the fasteners 41. Circular screen 39 made from aluminum at the intake end of air inlet cone 24 is nested within the channel between mount flange 35 and anchor flange 37 and is protectively enclosed and secured therein upon assembly of fasteners 41 into the corresponding molded insert fasteners 29.

The corresponding aligned apertures within the screen 39 and flanges 35, 37 are oversized with respect to fastener 41 to permit some transverse adjustment of the air inlet cone 24 with respect to the second axis 42 which extends through the molded unit blower housing 13. The body 27 of the air inlet cone 24 at its inner end terminates in the reverse curved convex annular throat 45 within chamber 26 and is adapted for projection into air inlet 95 of impeller 25.

Referring to FIGS. 1 and 3, outlet 15 is of circular cross-section and is molded into and is a unit part of blower housing 13. The outlet 15 defines with an end portion of outer wall 19 a reverse curved cut-off point 47 which extends substantially across the distance between front and rear walls 21 and 51.

The second axis 42 for impeller 25 is so arranged along and relative to first axis 16 that the impeller defines with the integral cut-off point 47 an optimum gap 49, FIG. 3, of reduced dimension for a maximum smooth nonturbulent substantially noiseless air flow through outlet 15. In the illustrative embodiment, the preferred gap is ¾", approximately. The cut-off point 47 is formed as an integral part of the molded unit blower housing 13 and in conjunction with impeller 25 defines the gap 49 as an optimum gap for maximum efficiency for a non-turbulent substantially noiseless air flow through outlet 15.

This is further assured as shown in FIG. 3 in view of the increasing dimension between impeller 25 and outer wall 19 and the corresponding progressively increasing cross-sectional shape of chamber 26, which merges into the transverse opening of increased dimension within air outlet 15.

The smooth interiors or surfaces of outer wall 19, the side walls 21 and 51 including the circular convex bosses 31 and the internal radiuses at 22 between the corresponding side walls and outer wall 19 provide for a smooth uninterrupted flow of pressurized air from the impeller, minimum obstruction and non-turbulence to produce a noiseless air flow through outlet 15. In the illustrative embodiment, rear wall 51 of the blower housing 13 has an annular bevel 53 therein, FIG. 4, defining a raised mount surface 55. Wall 21, after the housing 13 is removed from the mold, has the same configuration as wall 51, including the bevel 53 and raised surface 55. Such surfaces are removed from the housing 13, when the opening 23 is cut in wall 21.

The framework or support beam 57 fragmentarily shown in FIGS. 2 and 4 for a car wash dryer for illustration, though not limited thereto, includes support plate 59 upon which is mounted an electric motor 61 secured thereto by fasteners 63 having a drive shaft 65. Blower housing 13 when mounted upon motor 61, FIG. 2, has drive shaft 65 in alignment with the second axis 42 corresponding to the axis of air inlet opening 23 and air inlet cone 24.

Motor pilot plate 67 has a central aperture to receive drive shaft 65 and an axial recess 68 upon one side adapted to receive circular mount flange 69 provided on motor 61. Motor support plate 71 is positioned upon the interior of rear wall 51, rearwardly of mount surface 55 and includes an annular bevel 73 in registry with the interior corresponding annular bevel 53 upon the rear wall 51.

A plurality of fasteners 75 are introduced from the interior of chamber 26 through corresponding apertures in motor support plate 71, a motor pilot plate 67 into threaded engagement with threaded openings in motor 61 for anchoring the unit blower housing upon motor 61, FIGS. 2 and 4. The respective fasteners 75 extend through corresponding openings formed through rear wall 51 to complete the assembly. The foregoing assembly is sometimes referred to as means for aligning shaft 65 with the second axis 42 and for securing and mounting rear wall 51 of housing 13 upon motor 61.

Since the blower housing 13 of plastic material is mounted upon motor 61 and anchored thereto, it is important that the connection be properly reinforced by the use of the corresponding plates 67 and 71. Once the blower housing 13 has been properly affixed and anchored upon motor 61 and the corresponding drive shaft 65 projected through the respective plates and rear wall 51 and into chamber 26, the power driven impeller 25 is assembled thereover, FIG. 4.

The impeller 25 is a purchased item and includes an end mounting plate 77 with an annular out-turned edge 79 and a centrally arranged reinforcement disk 81 secured thereto as by welds 83. Hub 85 of machined steel is projected through disk 81 and end plate 77 and fixedly secured thereto by welding. Taper lock bushing 87 is projected into hub 85 and is adapted to cooperatively receive shaft 65 keyed thereto at 89 and retained in position by hub anchor plate 91, with corresponding fasteners 93, FIGS. 3 and 4, secured to the hub 85.

Impeller 25 at its end opposite plate 77 has a concave convex air intake cone or annular throated member 95 which is curved axially outward towards housing wall 21 and is adapted to cooperatively receive the throated outlet 45 of air intake cone 24, FIG. 4. The impeller 25 is completed by a series of spaced inwardly inclined hollow impeller blades 97 of a thin gauge metal for illustration, generally of a tear drop shape. The blades 97 have arcuate ends 99, FIG. 4, in registry with air intake cone 95 of the impeller 25 and are secured thereto by welds 101. The opposite flat ends 103 of the blades 97 engage end plate 77 and are secured thereto by corresponding welds 101. The outer peripheral portion of air intake cone 95 of the impeller 25 has an out-turned flange 105.

In the illustrative embodiment, FIGS. 1, 8 and 9, the blower housing is molded of plastic material and has an integral tangential outlet 15 of circular cross-section and includes rib 17 as a part thereof adapted to receive the flexible hose 107, fragmentarily shown.

In the illustrative embodiment the flexible hose 107 is made of a urethane or other flexible plastic material and is adapted for connection to an air nozzle for illustration for blowing water off a washed vehicle in a car wash in one illustrative embodiment of use of the present blower assembly.

Hose 107 includes a series of continuous spiral corrugations 108 which overlie outlet 15 and cooperatively registers with and interlocks with bead 17 on outlet 15 to prevent undesired disassembly of the hose 107 from the outlet 15 when the hose has been pressurized during operation of the blower assembly. In the illustrative embodiment the corrugations of hose 107 include a wire reinforcement 109, FIG. 9, for strengthening the hose and is molded thereinto. The hose is further anchored over outlet 15 by clamp assembly 111, FIGS. 1, 8 and 9. In the illustrative embodiment the clamp assembly 111 includes an elongated flexible metallic channel 113 which extends around the assembled hose 107 and outlet 15 with its laterally overlapped ends 115 overlying and in registry with a pair of adjacent corrugations 108 of the hose.

The clamp assembly includes a pair of aligned opposed spaced anchor strips 117 which loosely overlie the respective overlapped ends and adjacent intermediate portions of channel 113 and are respectively secured to the intermediate portions. The respective anchor strips 117 are welded to the intermediate portions respectively of channel 113 at 119, FIG. 1. Each of the anchor strips 117 have looped inner ends 121 and have a central slot 123, FIG. 9.

The clamp assembly 111 for the flexible hose 107 over outlet 15 sometimes referred to as clamp means includes adjustable fastening means which interconnect the respective anchor strips 117 for variably drawing up the intermediate connected portions of the channel thereby extending the overlapped ends 115 of the channel. In the illustrative embodiment the adjustable fastener means includes T-bolt 125 nested within the corresponding loop portion 121 of one strip 117 having a threaded shank which projects through a corresponding T-sleeve 127 nested and retained within the looped portion 121 of the other anchor strip 117. The T-bolt 125 receives cup-shaped washer 131 and threaded fastener 133 by which the corresponding anchor strips are drawn tightly towards each other for a snug drawing up and anchoring of underlying portions of hose 107 over outlet 15.

The foregoing description has been directed to a blower assembly including the details of the unit molded blower housing 13 of plastic material including in combination the air inlet cone 24, the electric motor 61 upon which the blower housing 13 is mounted and means for aligning motor shaft 65 and for anchoring the molded housing 13 upon the motor 61 and the power driven impeller 25 within chamber 26 of the blower housing 13.

The present invention is further directed to a unit blower housing 13 of FIG. 1 having the generally circular outer wall 19 and laterally spaced front and rear walls 21 and 51 defining an impeller chamber 26, generally of rectangular cross-section. The housing 13 terminates in an elongated tangential outlet 15 arranged upon a first axis adapted to receive a hose such as the flexible corrugated hose 107, fragmentarily shown in FIG. 1. Blower housing 13 is of a unit construction and is molded preferably of a high molecular weight polyethylene. One of the front and rear walls 21 and 51 is adapted to have a circular air inlet opening 23 cut or routed therein upon a second axis 42, FIG. 2, at right angles to and spaced from first longitudinal axis 16 of outlet 15. Another of the front and rear walls is adapted to have a plurality of apertures cut therein adapted to receive motor drive shaft 65 and the fasteners 75 for mounting wall 51, for illustration, upon motor 61 and securing the unit blower housing 13 thereon.

The unit molded blower housing 13 includes molded within one of its front and rear walls a plurality of spaced threaded insert fasteners which are molded into, interlocked with and non-rotatively enclosed within one of the front and rear walls and arranged in a circle. In the use of the present blower housing 13 depending upon how the housing mounted, as in FIG. 4, or opposite, the air inlet opening 23 is routed or cut within the corresponding one side wall, as for example wall 21, FIG. 2 inwardly of fasteners 29. Accordingly the present invention is directed to the unit blower housing per se, is a unit molded construction and includes within one of the side walls thereof the series of spaced insert fasteners 29 as an article of manufacture.

In the illustrative embodiment or preferred embodiment of the invention the blower housing 13 and outlet 15 have a uniform thickness of approximately ½".

While the air inlet cone assembly 24, 45, 35, 37 is a part of the combination illustrated in FIGS. 2 and 4 the air inlet cone 24 may be regarded as an article of manufacture as a unit to include the spun aluminum cone body 27 at one end having a mount flange 35,a reverse turned anchor flange 37 receiving and mounting a circular mesh screen 39. The opposite end of body 27 includes annular convex out-turned throated air outlet 45. It is contemplated that the present air inlet cone 24 is preferentially used in conjunction with the assembly defined and illustrated with respect to FIGS. 2 and 4, however the air inlet cone assembly 24 may have independent usage other than within the present unit blower assembly 13.

The present invention while including the adjustable clamp 111 as part of the blower assembly 13 defined with respect to FIGS. 1-9 may have independent usage as a clamp 111 for use with a pair of engaging overlapped inner and outer cylindrical members such as inner member or air outlet 15 and outer cylindrical member or hose 107. The clamp includes an elongated flexible metal channel 113 adapted to surround the overlapped inner and outer cylindrical members with opposite ends of the channel laterally overlapped. The adjustable clamp includes spaced anchor strips 117 looped at their inner ends as at 121 overlying the respective ends and adjacent intermediate portions of the channel 113 respectively with each anchor strip loosely engaging one channel end and secured to an adjacent intermediate portion of the channel. Adjustable fastening means are employed for interconnecting the anchor strips and for variably drawing up the intermediate portions extending the overlap 115 of the channel ends.

The present invention is further directed to the method of making the present unit blower housing 13 of molded plastic material having a tangential outlet 15 and comprising the following steps:

a. taking a two piece mold which when closed has an internal cavity corresponding to the outer configuration of the unit blower housing;
b. placing powdered or granular plastic in the cavity of the open mold in an amount sufficient to form the unit blower housing;
c. closing the mold and bolting it together;
d. moving the closed mold into a heated oven while rotationally rotating the mold to melt the plastic and distribute and fill the cavity with liquid plastic material and to thereby form the unit blower housing with a tangential outlet;
e. removing the heated mold from the oven and permitting the mold to cool either by air or by water to solidify the plastic blower housing with the tangential outlet 15; and
f. removing the solidified plastic blower housing from the mold.

The method includes the further step of inserting into the mold prior to its closing and rotation a plurality of spaced insert fasteners 29 whereby the fasteners are permanently embedded, enclosed within and anchored selectively within one of the side walls of the unit molded housing 13. In the method defined herein the fasteners 29 are arranged in a circle and there is the further step or steps of removing the housing 13 from the mold and then cutting or routing a circular opening in one of the side walls of the housing corresponding to the wall within which the fasteners 29 are anchored, inwardly of the fasteners providing an air inlet opening adapted to receive the air inlet cone 24, for illustration.

In the illustrative embodiment of the present blower housing 13, the housing is relatively small with respect to the size of the conventional impeller 25 so that approximately 30 to 40% of the total area of the housing previously required is eliminated.

The preferred plastic material namely a high molecular weight polyethylene was high lubricity despite the fact that it will flow. The impeller 25 is a large impeller with respect to a relatively small housing 13. The important cut-off point 47 with respect to impeller 25 as shown in FIGS. 1 and 3 is molded as an integral part of the unit blower housing 13.

The use of the taper lock bushing 87, key 89 and its hub anchor plate 91 provides an easy way of disengaging and disassembling the impeller 25 from the motor and for removal from the housing 13, once the air inlet cone 24 has been removed.

The inlet cone assembly shown at 24, FIGS. 2 and 4 anchors and mounts the periphery of the screen 39 within the channel defined by the corresponding flanges 35 and 37, FIG. 5, so as to anchor and protectively receive the edges of the screen.

Having described our invention reference should now be had to the following claims.

We claim:

1. A blower assembly comprising a unit blower housing of molded plastic material having a generally circular outer wall and laterally spaced front and rear walls defining an impeller chamber of rectangular cross-section;

said housing terminating in an elongated tangential outlet arranged upon a first axis adapted to receive a flexible hose;

said elongated tangential outlet defining with an end portion of said outer wall a reverse curved cut off point extending substantially across the distance between said front and rear walls;

said front wall having a circular air inlet opening to said impeller chamber, arranged upon a second axis at right angles to and spaced from said first axis;

an air inlet cone projected through the inlet opening in said front wall, said inlet cone at one end having an annular mount flange overlying and secured to said front wall and at its other end terminating in an annular convex throated outlet;

an electric motor upon a support having a drive shaft extending along said second axis and projected through said rear wall and into said impeller chamber;

a circular mount flange on said motor coaxial of said drive shaft;

means for aligning said drive shaft with said second axis and for securing and mounting said rear wall upon said motor;

said aligning means including a motor pilot plate having a circular recess upon said second axis arranged upon the exterior of said rear wall;

said circular mount flange of said motor being axially nested and retained within the circular recess of said pilot plate; and a power driven impeller nested within said impeller chamber axially mounted upon said second axis and secured to said drive shaft and having an air intake receiving the annular convex throated outlet of said air cone outlet;

said second axis being so arranged along with said first axis that said impeller defines with said cut-off point an optimum gap of reduced dimension for a maximum smooth non turbulent substantially noiseless air flow through said elongated tangential outlet;

a circular air screen mounted upon, spanning and secured to said inlet cone mount flange; and said mount flange of said air inlet cone having an annular reverse turned anchor flange overlying said mount flange defining a channel, said circular air screen being peripherally nested and protectively anchored within said mount flange channel.

2. In the blower assembly of claim 1, wherein the plastic material of said blower housing is a high molecular weight polyethylene.

3. In the blower assembly of claim 1, wherein said outer wall starting from said end portion being of progressively increasing radius and merging with said elongated tangential outlet.

4. In the blower assembly of claim 1, including an annular rib adjacent and integral with the end of said elongated tangential outlet;

an elongated flexible hose of corrugated form at one end snugly overlying said elongated tangential outlet and interlocked with said rib against relative longitudinal movement; and an adjustable clamp means extending around and compressively engaging said hose and elongated tangential outlet.

5. In the blower assembly of claim 1, including a plurality of threaded insert fasteners molded and interlocked and non rotatably enclosed within said front wall around said inlet opening;

said air cone mount flange overlying said insert fasteners with corresponding apertures in registry with said insert fasteners; and a plurality of fastening elements extending through said mount flange and into said insert fasteners.

6. In the blower assembly of claim 5, wherein said plastic blower housing and said insert fasteners being rotationally molded with said insert fasteners permanently embedded and enclosed within said front wall and flush therewith and anchored against relative longitudinal and rotational movements.

7. In the blower assembly of claim 1, wherein said impeller being oversized with respect to said impeller chamber, said optimum gap defined by said cut-off point in said blower housing being $\frac{3}{4}''$, approximately, for a non-turbulent free flow of pressure air through said elongated tangential outlet with greatly reduced noise level and high efficiency.

8. In the blower assembly of claim 1, wherein said impeller being adapted for counterclockwise rotation;

the mounting of said blower housing and said inlet cone being reversible to said front wall and rear wall respectively, said air inlet opening being selectively formed in said rear wall and said impeller being adapted for clockwise rotation.

9. In the blower assembly of claim 1, including a plurality of spaced forwardly and inwardly inclined blades within said impeller rotatable around said second axis and radially outletting into said impeller chamber;

said outer wall defining said impeller chamber starting at said cut-off point being of progressively increasing radial dimension and transverse cross-sectional dimension from the impeller perimeter, with the maximum dimension and cross-sectional area at said elongated tangential outlet adjacent said gap to provide a smooth nonturbulent substantially noiseless pressure air flow through said elongated tangential outlet.

10. A blower assembly comprising a unit blower housing of molded plastic material having a generally circular outer wall and laterally spaced front and rear walls defining an impeller chamber of rectangular cross-section;

said housing terminating in an elongated tangential outlet arranged upon a first axis adapted to receive a flexible hose;

said elongated tangential outlet defining with an end portion of said outer wall a reverse curved cut off point extending substantially across the distance between said front and rear walls;

said front wall having a circular air inlet opening to said impeller chamber, arranged upon a second axis at right angles to and spaced from said first axis;

an air inlet cone projected through the inlet opening in said front wall, said inlet cone at one end having an annular mount flange overlying and secured to said front wall and at its other end terminating in an annular convex throated outlet;

an electric motor upon a support having a drive shaft extending along said second axis and projected through said rear wall and into said impeller chamber;

a circular mount flange on said motor coaxial of said drive shaft;

means for aligning said drive shaft with said second axis and for securing and mounting said rear wall upon said motor;

said aligning means including a motor pilot plate having a circular recess upon said second axis arranged upon the exterior of said rear wall;

said circular mount flange of said motor being axially nested and retained within the circular recess of said pilot plate; and a power driven impeller nested within said impeller chamber axially mounted upon said second axis and secured to said drive shaft and having an air intake receiving the annular convex throated outlet of said air cone outlet;

said second axis being so arranged along with said first axis that said impeller defines with said cut-off point an optimum gap of reduced dimension for a maximum smooth non turbulent substantially noiseless air flow through said elongated tangential outlet;

said securing means including a motor support plate arranged upon the interior of said rear wall upon said second axis;

said motor pilot plate, rear wall and motor support plate being apertured to receive said drive shaft; and a plurality of fastening elements extending axially through said plates and rear wall and secured to the circular mount flange of said motor.

11. In the blower assembly of claim 10, wherein said means for mounting said blower housing further including an annular out turned bevel on said rear wall defining a raised mount surface receiving said pilot plate, said motor mount plate having an annular bevel in registry with the beveled portion of said rear wall.

12. In the blower assembly of claim 5, wherein said insert fasteners being polygonal in shape, said insert fasteners having an annular groove of reduced diameter intermediate its ends to receive plastic material to provide the interlock with said front wall.

13. In the blower assembly of claim 1, wherein said impeller including an apertured circular end mount plate arranged upon said second axis;

an annular concave-convex air intake member spaced from said mount plate arranged upon said second axis, having a throated inlet receiving the annular convex throated outlet of said air intake cone; and a plurality of blades inclined inwardly from the periphery of said impeller mount plate secured at their opposite ends to said impeller mount plate and intake member defining therewith a series of uniform outlets to said impeller chamber.

14. In the blower assembly of claim 1, wherein said impeller including an apertured circular mount plate arranged upon said second axis;

an axial hub extending through said last mentioned mount plate and secured thereto axially receiving said drive shaft and keyed thereto;

a taper lock bushing anchored within said hub journaling said drive shaft; and a coaxial hub anchor plate retainingly engaging said hub and fixedly secured to said bushing.

* * * * *